US006050405A

United States Patent [19]

Rossi et al.

[11] Patent Number: 6,050,405

[45] Date of Patent: Apr. 18, 2000

[54] GOLF CLUB LOCK

[75] Inventors: John M. Rossi, Melbourne; Don E. Wogoman, Palm Bay, both of Fla.

[73] Assignee: Golf Lock, Inc., Melbourne, Fla.

[21] Appl. No.: 09/017,717

[22] Filed: Feb. 4, 1998

[51] Int. Cl.[7] ..... A63B 57/00

[52] U.S. Cl. ..... 206/315.2; 206/315.6; 211/70.2

[58] Field of Search ..... 206/315.2, 315.6; 211/70.2; 70/70, 19, 58, 78; 132/145

[56] References Cited

U.S. PATENT DOCUMENTS

| | | | |
|---|---|---|---|
| D. 336,603 | 6/1993 | Penaflor | D8/336 |
| 1,377,413 | 5/1921 | Dwelle . | |
| 1,835,632 | 12/1931 | Buhrke | 211/70.2 |
| 2,070,254 | 2/1937 | Burgner | 211/70.2 |
| 3,232,503 | 2/1966 | Thonen | 211/70.2 |
| 3,985,275 | 10/1976 | Allen | 70/58 X |
| 4,538,728 | 9/1985 | Lewis | 206/315.3 |
| 4,863,019 | 9/1989 | Lewis et al. | 206/315.3 |
| 4,955,472 | 9/1990 | Yamazoe | 206/315 |
| 5,004,100 | 4/1991 | Smith | 206/315.2 |
| 5,520,291 | 5/1996 | Graham | 70/58 X |
| 5,524,753 | 6/1996 | Murphy | 206/315.6 |
| 5,590,772 | 1/1997 | Schuhlen et al. | 206/315.3 |
| 5,597,000 | 1/1997 | Gerber | 132/145 X |
| 5,638,836 | 6/1997 | Yasuda | 132/145 X |

FOREIGN PATENT DOCUMENTS

| | | | |
|---|---|---|---|
| 2181410 | 1/1997 | Canada | 206/315.6 |
| 9604045 | 2/1996 | WIPO | 206/315.6 |

*Primary Examiner*—Sue A. Weaver
*Attorney, Agent, or Firm*—Brian S. Steinberger; Law Offices of Brian S. Steinberger

[57] ABSTRACT

A golf club lock having a disc with semi-circular halves hinge connected to one another. Each half section having slots with rows of teeth separated by one another by slots therebetween. Each teeth row having a different end length than the adjacent row. The user opens the disc and positions the teeth rows about the shafts of the golf clubs. By jiggling the halve sections, the teeth ends of the individual rows allow the shafts of the golf clubs to pass and fall into individual slots, without having the user physically touch each golf club. The semi-circular halves surround the shafts of the clubs and rack them together.

12 Claims, 6 Drawing Sheets

5
0.5000
T
35
D
30
28
40
58
5
22
54
20
52
18
50
16
48
14
12
46
42
4.7434
4.7434
A
29
10
56
0.2500
S
0.6250
26
1

220
230
200
201
202
206
208
210
212
214
216
225
227
232
234
235
236
S2
C1
C2
T2
0.250
0.250
4.743
4.743
D2

GOLF CLUB LOCK

This invention relates to golf clubs, and in particular to an apparatus for locking golf clubs together in a golf club bag.

BACKGROUND AND PRIOR ART

In recent years, golf clubs have become very expensive commodities with values of upwards of several hundred dollars apiece. Attempts have been made over the years to secure golf clubs together to golf bags. See for example: U.S. Pat. No. Des. 336,603 to Penaflor; U.S. Pat. No. 1,377,413 to Dwelle; U.S. Pat. No. 4,538,728 to Lewis; U.S. Pat. No. 4,863,019 to Lewis et al.; U.S. Pat. No. 4,955,472 to Yamazoe; U.S. Pat. No. 5,004,100 to Smith; U.S. Pat. No. 5,590,772 to Schuhlen et al. However, the prior art has inherent problems. Dwelle'413 and Lewis et al. '019 are limited to latching only a single row of golf clubs together after the clubs are manually positioned within a U-shaped holder. Penaflor '603; Smith '100 and Schuhlen et al. '772 each requires the user manually hold the neck region of each club and then position the clubs individually into longitudinal slots, which is inherently time consuming. Lewis '728 shows two semi-circular halves with a center hole that forces the necks of several golf clubs to be held together after a user must manually position each of the clubs toward the center axis of the bag, which is even more difficult if the bag itself has built in grids for separating the clubs. Yamazoe '728 shows fixed grids which require the user lift the golf clubs individually and insert the handle end first therein.

Thus, there exists a need for improvements over the prior art of record.

SUMMARY OF THE INVENTION

The first objective of the present invention is to provide a golf club lock having slots for separating golf clubs into various rows.

The second object of this invention is to provide a golf club lock where the user can lock the golf clubs together in a bag without the user having to physically touch and manipulate each of the clubs into the lock.

The third object of this invention is to provide a golf club lock where the user can hold sides halves having slots, and jiggle the sides about golf clubs so that the club shafts move and pass into the slots within the side halves.

A preferred embodiment of the golf club lock includes a first semi-circular half having first rows of teeth separated from one another by slots, the first rows of teeth having first teeth row ends, a second semi-circular half having second rows of teeth separated from one another by slots, the second rows of teeth having second teeth row ends, and a hinge for allowing the first semi5 circular half and the second semi-circular half to move from an open position to a closed position. A separation space is formed between the first teeth row ends and the second teeth row ends, when the first lock half and the second lock half are in the closed position. The first teeth row ends have short lengths alternating with longer lengths, and the second teeth row ends have the longer lengths alternating with the short lengths. In the closed position, the separation space between the first teeth row ends and the second teeth row ends, is in an off-axis line. The separation space can be approximately 0.5 inches to approximately 0.6 inches wide. Each of the teeth rows can have a width of approximately 0.5 to approximately 0.6 inches. Each half section can have five rows of teeth with six slots therebetween, or six rows of teeth with seven slots therebetween.

When operating the lock, the user manipulates the open positions of the first semi-circular half and the second semi-circular half about golf clubs in a bag and jiggles the golf clubs into the slots between the first rows and the second rows, and moves the first semi-circular half and the second semi-circular half to the closed position, without having to physically touch nor manipulate each of the golf clubs. The user can further use a padlock or combination lock to hold the half sections together.

Further objects and advantages of this invention will be apparent from the following detailed description of a presently preferred embodiment which is illustrated schematically in the accompanying drawings.

BRIEF DESCRIPTION OF THE FIGURES

FIG. 2C is a side view of the top semi-circular half section of FIG. 2A along arrow B2.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figures 1A, 1B:
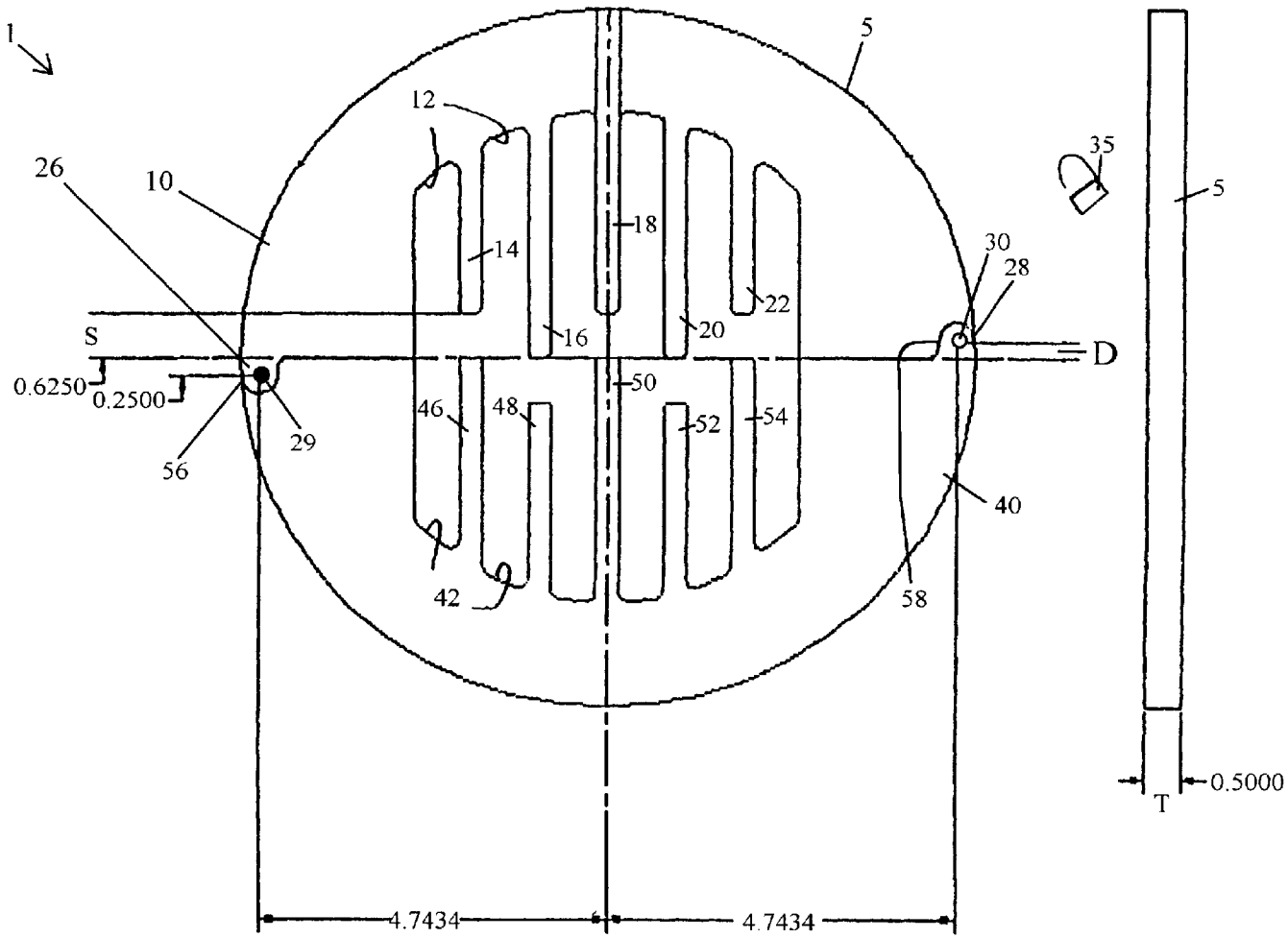
FIG. 1A is a front view of the novel golf club lock invention with six slots.
FIG. 1B is a side view of the golf club lock of FIG. 1A along arrow A.

FIG. 1A is a front view of the novel golf club lock invention 1 with six slots 12, 42 in the top semi-circular half section 10 and the bottom semi-circular half section 40. FIG. 1B is a side view of the golf club lock 1 of FIG. 1A along arrow A. Referring to FIGS. 1A and 1B, golf lock 1 has a disc shape 5 with a diameter of approximately 10 inches and a thickness T, of approximately 0.5 to approximately 0.625 inches. Golf lock 1 has a top semi-circular half section 10 with five rows of teeth. The five rows having alternating short length rows 14, 18, and 22 and longer length rows 16, 20. The longer length rows having ends along the mid diameter half axis D, of the disc lock 5. The short length rows 14, 18, and 22 having ends with spacings S, of approximately 0.5 to approximately 0.625 inches to the ends of opposite teeth 46, 50, and 54. Golf lock 1 has a bottom semi-circular half section 40 with five rows of teeth. The five rows having alternating short length rows 48, 52 and longer length rows 46, 50, and 54. The longer length rows having ends along the mid diameter half axis D, of the disc lock 5. The short length rows 48 and 52 having ends with spacings S, of approximately 0.5 to approximately 0.625 inches to the mid diameter half axis mark D. Top semi-circular half section 10 has a flange 26 that hingedly connects by a pin 29 to a mateable flange 56 on bottom semi-circular half section 40. Top semi-circular hall section 10 has an opposite located flange 28 that overlaps a mateable flange 58 on bottom semi-circular half section 40, where a through-hole 30 passes through both top flange 28 and bottom flange 58 and a lock 35 can hold top and bottom semi-circular half sections 10 and 40 together. In the closed position of the lock 1 shown in FIG. 1A, an off-axis spacing line of approximately 0.5 to approximately 0.625 inches, runs down the mid-diameter of the disc 5. Disc 5 can be formed from materials such as but not limited to lexan, hardened injection molded plastic, aluminum, and the like. The operation of the novel lock 1 will be described in reference to FIGS. 4A–4D.

Figures 2A, 2B:
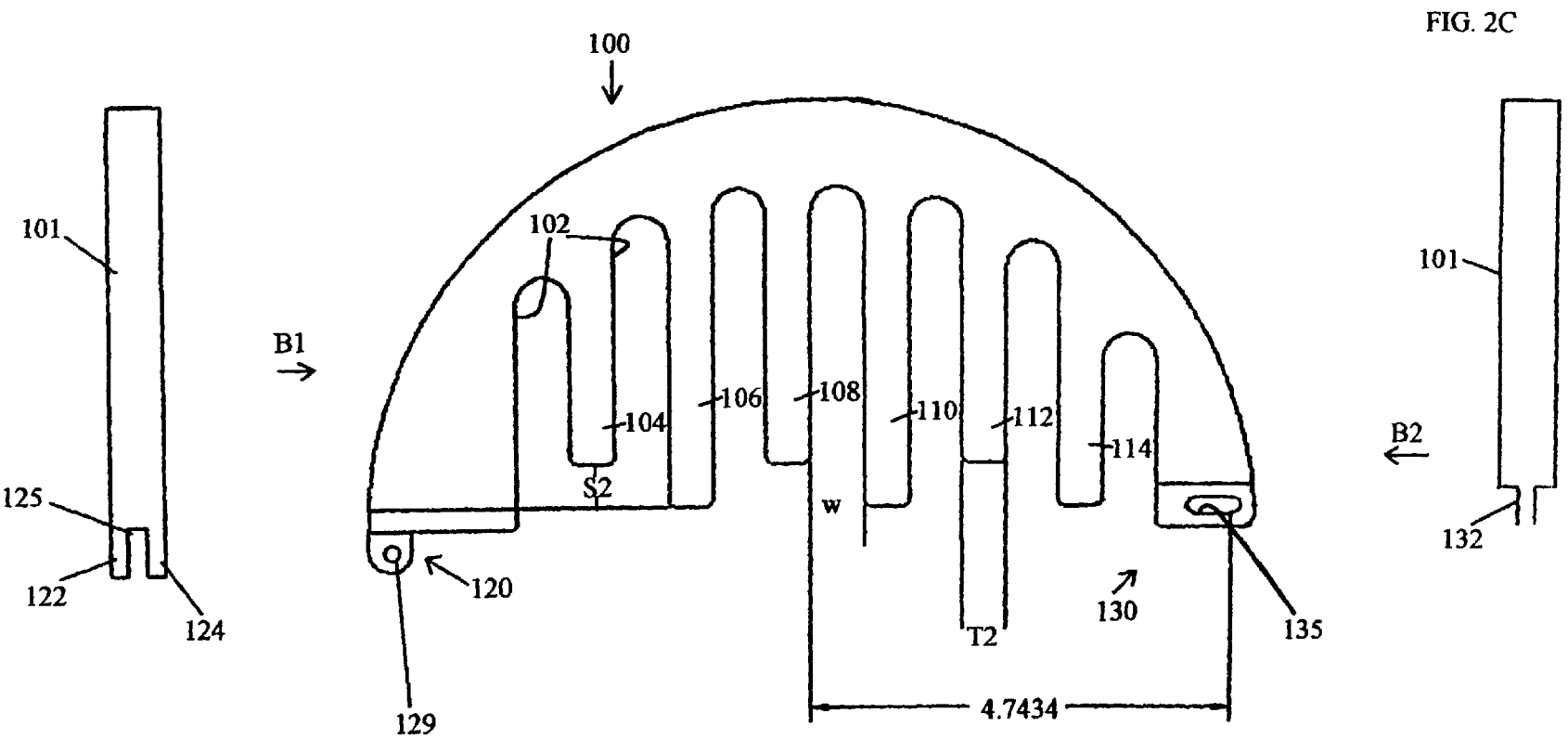
FIG. 2A a front view of the top semi-circular half section of the golf club lock of FIG. 1A with a seven slots version.
FIG. 2B is a side view of the top semi-circular half section of FIG. 2A along arrow B1.

FIG. 2A a front view of the top semi-circular half section 100 of the golf club lock 1 of FIG. 1A with a seven slots 102 version, each having a width, W of approximately 0.5 to approximately 0.625 inches. FIG. 2B is a side view of the top semi-circular half section 100 of FIG. 2A along arrow B1. FIG. 2C is a side view of the top half section 100 of FIG. 2A along arrow B2. Referring to FIGS. 2A–2C, top semi-circular half section 100 has short teeth rows 104, 108, 112 alternating with longer teeth rows 106, 110, and 114. The short teeth rows 104, 108, 112 are each approximately 0.5 to approximately 0.625 inches shorter than long teeth rows 106, 110, 114 so that an off-axis spacing S2 of approximately 0.5 to approximately 0.625 inches exists between the ends of the teeth rows of top semi-circular half section 100 of FIG. 2A and the ends of the adjoining teeth rows of bottom semi-circular half section 200 of FIG. 3A.

Referring to FIGS. 2A–2C, each of the teeth rows has a width T2 of approximately 0.5 to approximately 0.625 inches, and the thickness, 101 of the semi-circular half section 100 is approximately 0.5 to approximately 0.625 inches. Semi-circular half section 100 has a left end connector 120 having two parallel flanges 122, 124 with a spacing 125 therebetween, and a right end connector 130 having a flange protrusion 132 with a horizontal longitudinal through-hole 135.

Figures 3A, 3B, 3C:
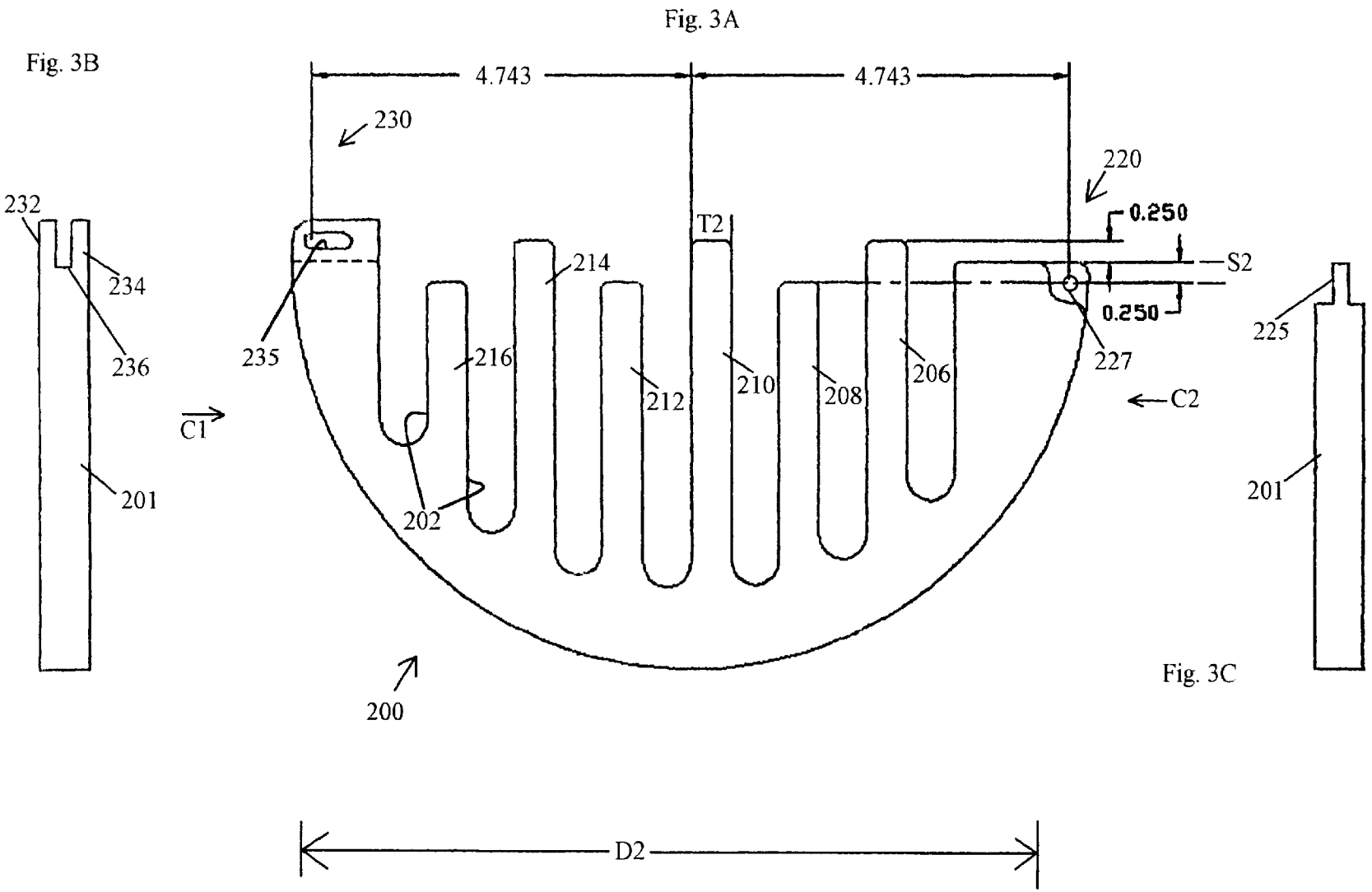
FIG. 3A of a front view of the bottom semi-circular half section of the golf club lock of FIG. 1A with the seven slots version.
FIG. 3B is a side view of the bottom semi-circular half section of FIG. 3A along arrow C1.
FIG. 3C is a side view of the bottom semi-circular half section of FIG. 3A along arrow C2.

FIG. 3A of a front view of the bottom semi-circular half section 200 of the golf club lock 1 of FIG. 1A with seven slots 202. FIG. 3B is a side view of the bottom semi-circular half section 200 of FIG. 3A along arrow C1. FIG. 3C is a side view of the bottom semi-circular half section 200 of FIG. 3A along arrow C2. Referring to FIGS. 3A–3C, top semi-circular half section 200 has short teeth rows 208, 212, 216 alternating with longer teeth rows 206, 210, and 214. The short teeth rows 208, 212, 216 are each approximately 0.5 inches shorter than long teeth rows 206, 210, and 214 so that an off-axis spacing S2 of approximately 0.5 inches exists between the ends of the teeth rows of top semi-circular half section 100 of FIG. 2A and the ends of the adjoining teeth rows of bottom semi-circular half section 200 of FIG. 3A.

Referring to FIGS. 3A–3C, each of the teeth rows has a width T2 of approximately 0.5 inches, and the thickness, 201 of the semi-circular half section 200 is approximately 0.625 inches. Semi-circular half section 200 has a left end connector 220(FIG. 3A is flipped around) with a narrow flange protrusion 225 and a through-hole 227 which is hingedly connected to a pin 129 in top half 100(FIG. 2A) passing therethrough. Semi-circular half section 200 further includes a right end connector 230(FIG. 3A is shown flipped around) having two parallel flanges 232, 234 with a spacing 236 therebetween, and a horizontal longitudinal through-hole 235 through both flanges 232, 234, which mateably overlaps through-hole 135 of right flange 130 of top half section 100(FIG. 2A). A lock such as 35 of FIG. 1A can be used to lock top half 100(FIG. 2A) to bottom half 200(FIG. 2A).

Figure 4A:
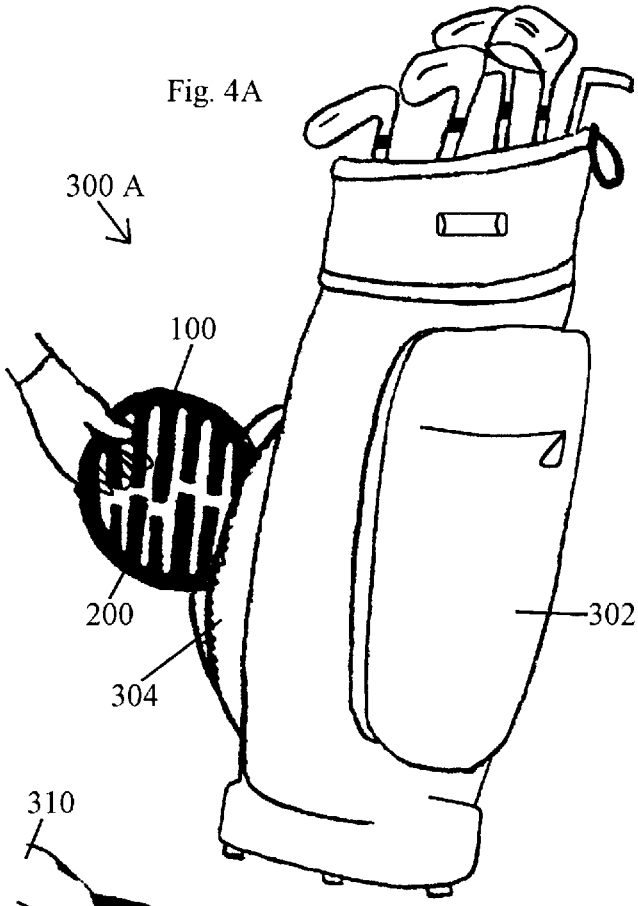
FIG. 4A is a perspective view of the semi-circular half sections of FIG. 2A and FIG. 3A being removed from a golf club bag.
Figure 4B:
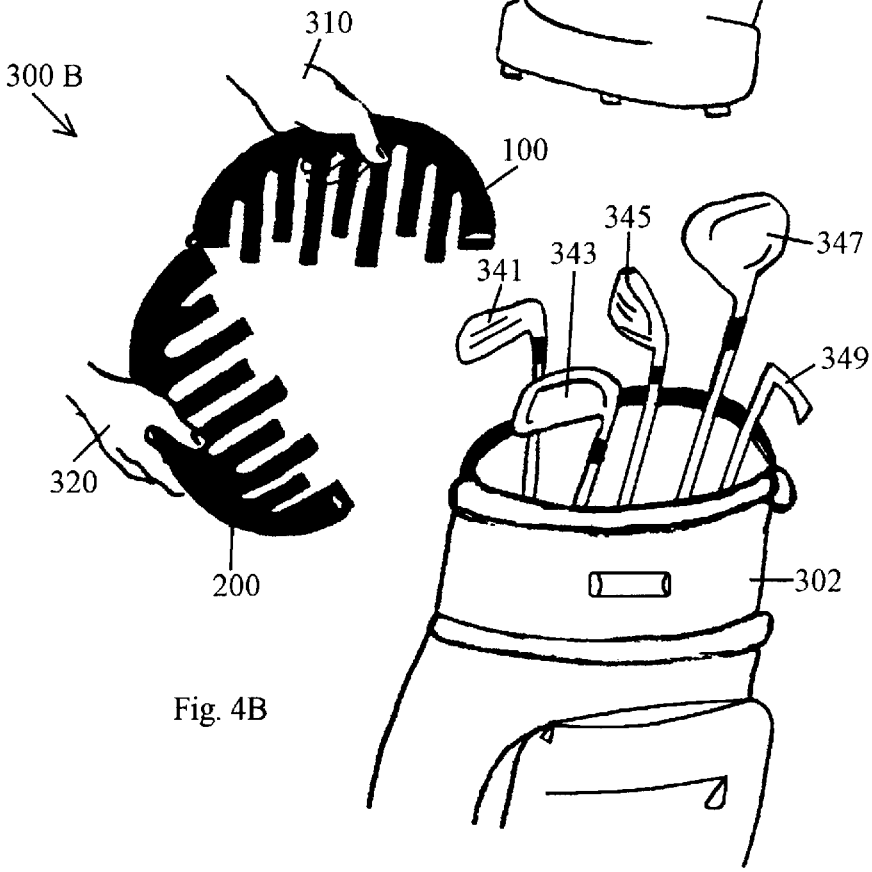
FIG. 4B is a perspective view of the semi-circular half sections of FIG. 4A being separated into its half sections and about to be positioned about the necks of the golf clubs.

FIG. 4A is a perspective view 300A of the semi-circular half sections 100 of FIG. 2A and 200 FIG. 3A being removed from a golf club bag side compartment 304 of a golf bag 302. FIG. 4B is a perspective view 300B of the semi-circular half sections of FIG. 4A being separated into its half sections 100, 200 by a users left hand 310 and right hand 320, respectively, and about to be positioned about the shafts of the golf clubs 341, 343, 345, 347, 349.

Figure 4C:
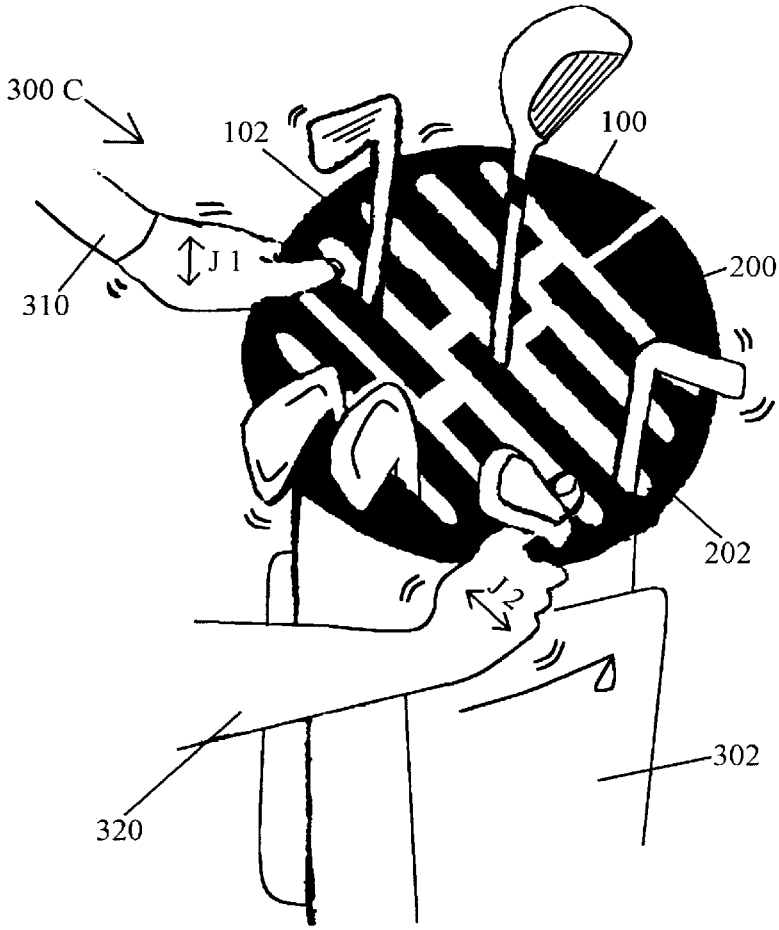
FIG. 4C is a perspective view of the user jiggling the semi-circular half sections of the lock about the necks of the golf clubs.
Figure 4D:
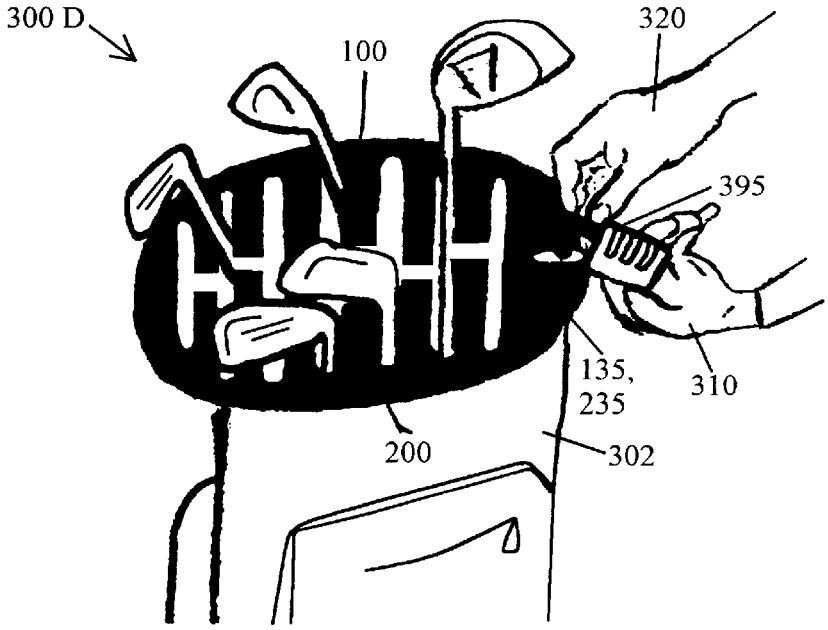
FIG. 4D is a perspective view of the user locking the half sections of the lock together.

FIG. 4C is a perspective view 300C of the user jiggling the semi-circular half sections 100, 200 with left hand 310 moving back and forth in the opposing directions of arrow J1, and with right hand 320 moving back and forth in the opposing directions of arrow J2, so that the shafts of respective golf clubs 341, 343, 345, 347 and 349 move and fall/pass into respective slots 102 and 202. The semi-circular half sections 100, 200 surround the shafts of the clubs 341, 343, 345, 347, 349, and rack them together when lock sections 100, 200 are closed. This jiggling action allows the golf clubs to be positioned within the slots 102, 202 without having the user physically manipulate any of the golf clubs 341, 343, 345, 347 and 349. The shafts of the golf clubs 341, 343, 345, 347 and 349 are generally less than the spacing width of approximately 0.5 to approximately 0.625 inches which exists for each of the slots 102, 202. FIG. 4D is a perspective view 300D of the user 310, 320 locking the half sections 100, 200 together with a padlock or combination lock 395 passing through respective through-holes 135, 235 of half sections 100 and 200.

Figure 5:
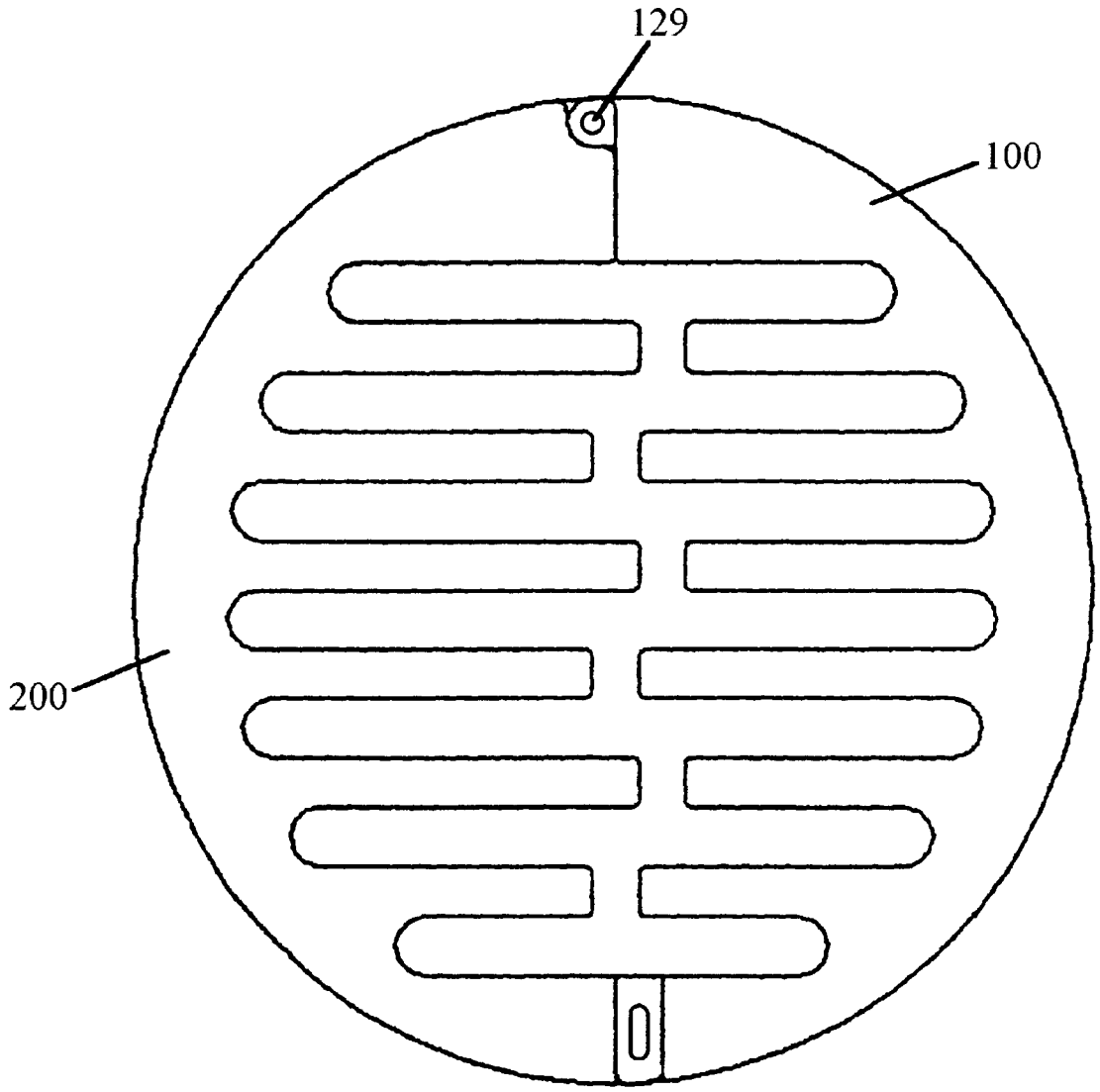
FIG. 5 shows an assembled view of the top and bottom half sections of FIGS. 2A–2C and 3A–3C attached to one another.

FIG. 5 shows an assembled view of the top and bottom half sections 100, 200, respectively of FIGS. 2A–2C and 3A–3C attached to one another.

Although the preferred embodiment describes the lock as having a circular exterior, the lock can include other shapes such as but not limited to square, rectangular, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An apparatus for locking golf clubs together, comprising:

a first lock half having first rows of teeth separated from one another by slots, the first rows of teeth having first teeth row ends;

a second lock half having second rows of teeth separated from one another by slots the second rows of teeth having second teeth row ends;

a separation space formed between the first teeth row ends and the second teeth row ends; and a hinge for allowing the first lock half and the second lock half to move from an open position to a closed position, wherein a user manipulates the open position of the first lock half and the second lock half about golf clubs in a bag and jiggles the golf clubs into the slots between the first rows and the second rows, and moves the first lock half and the second lock half to a closed position, without having to physically touch nor manipulate each of the golf clubs.

2. The apparatus for locking golf clubs together of claim 1, wherein the first lock half and the second lock half includes:

semi-circular disc shapes.

3. The apparatus for locking golf clubs together of claim 1, wherein the separation space is: approximately 0.5 inches to approximately 0.6 inches.

4. The apparatus for locking golf clubs together of claim 1, wherein the first teeth row ends has short lengths alternating with longer lengths, and the second teeth row ends has the longer lengths alternating with the short length lengths, and the separation space between the first teeth row ends and the second teeth row ends is in an off-axis line.

5. The apparatus for locking golf clubs together of claim 4, wherein the separation space is:

approximately 0.5 inches to approximately 0.6 inches.

6. The apparatus for locking golf clubs together of claim 1, wherein each of the first rows of teeth and each the second rows of teeth include:

a teeth row width of approximately 0.5 inches.

7. The apparatus for locking golf clubs together of claim 1, further including:

five rows of first rows of teeth with six slots therebetween; and five rows of second rows of teeth with six slots therebetween.

8. The apparatus for locking golf clubs together of claim 1, further including:

six rows of first rows of teeth with seven slots therebetween; and six rows of second rows of teeth with seven slots therebetween.

9. An apparatus for locking golf clubs together, comprising:

a first semi-circular half having first rows of teeth separated from one another by slots, the first rows of teeth having first teeth row ends;

a second semi-circular half having second rows of teeth separated from one another by slots, the second rows of teeth having second teeth row ends;

a hinge for allowing the first semi-circular half and the second semi-circular half to move from an open position to a closed position;

a separation space formed between the first teeth row ends and the second teeth row ends, when the first lock half and the second lock half are in the closed position, wherein a user manipulates the open position of the first semi-circular half and the second semi-circular half about golf clubs in a bag and jiggle the golf clubs into the slots between the first rows and the second rows, and moves the first semi-circular half and the second semi-circular half to the closed position, without having to physically touch nor manipulate each of the golf clubs.

10. The apparatus for locking golf clubs together of claim 9, wherein the first teeth row ends has short lengths alternating with longer lengths, and the second teeth row ends has the longer lengths alternating with the short lengths, and the separation space between the first teeth row ends and the second teeth row ends is in an off-axis line.

11. An apparatus for locking longitudinal shafts together, comprising in combination:

a first section member;

a second section member;

a hinge mean for joining the first section member to the second section member to move between an open position and a closed position;

at least one of the first section and the second section includes:

a row of parallel spaced apart teeth members of alternating lengths; and longitudinal shafts of golf clubs, wherein a user manipulates the open position of the first section member and the second section member about the longitudinal shafts and jiggles the longitudinal shafts into spaces between each of the parallel spaced apart teeth members, and moves the first section member and the second section member to a closed position, without having to physically touch nor manipulate each of the longitudinal shafts.

12. The apparatus of claim 11, wherein both the first section and the second section include:

the row of parallel spaced apart teeth members of alternating lengths.

* * * * *